US007312769B2

(12) United States Patent
Arai et al.

(10) Patent No.: US 7,312,769 B2
(45) Date of Patent: Dec. 25, 2007

(54) DRIVING CIRCUIT FOR VACUUM FLUORESCENT DISPLAY

(75) Inventors: Hiroyuki Arai, Gunma (JP); Syuji Motegi, Tochigi (JP); Takeshi Kimura, Tochigi (JP); Tetsuya Tokunaga, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 653 days.

(21) Appl. No.: 10/808,588

(22) Filed: Mar. 25, 2004

(65) Prior Publication Data

US 2004/0212569 A1 Oct. 28, 2004

(30) Foreign Application Priority Data

Mar. 28, 2003 (JP) ..... 2003-091673

(51) Int. Cl.
*G09G 3/22* (2006.01)

(52) U.S. Cl. ..... 345/75.1; 315/169.3

(58) Field of Classification Search ..... 315/77, 315/169.1–169.4; 345/47, 75.1
See application file for complete search history.

(56) References Cited

U.S. PATENT DOCUMENTS 4,791,337 A * 12/1988 Murata ..... 315/169.1
4,859,912 A * 8/1989 Lippmann et al. ..... 315/169.3
4,968,917 A * 11/1990 Harris ..... 315/77
5,099,178 A 3/1992 Bozzer et al.
5,155,413 A * 10/1992 Bozzer et al. ..... 315/169.1
6,005,538 A * 12/1999 Hoekstra ..... 345/47

OTHER PUBLICATIONS

MSC1205 Data Sheet, (Oki Semiconductor), "32-Bit Duplex Controller/Driver with Digital Dimming Function," (English translation), Jan. 1998, 29 pages.
MSC1215-01-Data Sheet, (Oki Semiconductor), Sep. 2000, 22 pages.
ML9213 Data Sheet (Oki Semiconductor), Sep. 2001, 20 pages.
MSM9210, 32-bit duplex/triplex (1/2 duty/ 1/3 duty) VF Controller/Driver with Digital Dimming, May 2000, OKI Electric Industry Co., Ltd., Japan, XP00292142, pp. 1-20.

* cited by examiner

*Primary Examiner*—Amare Mengistu
*Assistant Examiner*—Yuk Chow
(74) *Attorney, Agent, or Firm*—Fish & Richardson P.C.

(57) ABSTRACT

A driving circuit for a vacuum fluorescent display having a filament, a grid electrode and a segment electrode, comprising a grid driving unit for pulse-driving the grid electrode, a segment driving unit for pulse-driving the segment electrode, a first controlling unit for rendering adjustable the duty ratio of the output of the grid driving unit, a second controlling unit for rendering adjustable the duty ratio of the output of the segment driving unit, and a selecting unit for selecting the first controlling unit and/or the second controlling unit.

6 Claims, 8 Drawing Sheets

| DIMMER TYPE SELECT FLAGS | | OUTPUT STATUS | OUTPUT WAVEFORM | |
|---|---|---|---|---|
| GD | SD | Gn AND Sn TERMINALS | Gn TERMINAL | Sn TERMINAL |
| 0 | 0 | SETTING NOT ALLOWED | —— | —— |
| 0 | 1 | DIMMER ADJUSTMENT FOR Sn OUTPUT ONLY | | |
| 1 | 0 | DIMMER ADJUSTMENT FOR Gn OUTPUT ONLY | | |
| 1 | 1 | DIMMER ADJUSTMENT FOR BOTH Gn AND Sn OUTPUTS | | |

FIG.4

| DIMMER ADJUSTMENT DATA | | | | | | | | | | |
|---|---|---|---|---|---|---|---|---|---|---|
| DM9 | DM8 | DM7 | DM6 | DM5 | DM4 | DM3 | DM2 | DM1 | DM0 | DIMMER VALUE (TW/T) |
| 0 | 0 | 0 | 0 | 0 | 0 | 0 | 0 | 0 | 0 | 0/1024 |
| 0 | 0 | 0 | 0 | 0 | 0 | 0 | 0 | 0 | 1 | 1/1024 |
| 0 | 0 | 0 | 0 | 0 | 0 | 0 | 0 | 1 | 0 | 2/1024 |
| | | | | ≀ | | | | | | ≀ |
| 1 | 1 | 1 | 1 | 1 | 1 | 1 | 1 | 0 | 0 | 1020/1024 |
| 1 | 1 | 1 | 1 | 1 | 1 | 1 | 1 | 0 | 1 | 1021/1024 |
| 1 | 1 | 1 | 1 | 1 | 1 | 1 | 1 | 1 | 0 | 1022/1024 |
| 1 | 1 | 1 | 1 | 1 | 1 | 1 | 1 | 1 | 1 | SETTING NOT ALLOWED |

(b)

(a)

(b)

(c)

DRIVING CIRCUIT FOR VACUUM FLUORESCENT DISPLAY

CROSS-REFERENCE TO RELATED APPLICATIONS

This application claims the benefit of priority to Japanese Patent Application No. 2003-91673 filed on Mar. 28, 2003, of which contents are incorporated herein by reference.

BACKGROUND OF THE INVENTION

1. Field of the Invention

The present invention relates to a driving circuit for a vacuum fluorescent display.

2. Description of the Related Art

A vacuum fluorescent display (hereinafter, referred to as "VFD") is a display device of a self-illuminating type for displaying a desired pattern by causing a direct-heating type cathode called a filament to emit thermoelectrons by causing it to generate heat by applying a voltage thereto in a vacuum chamber and by causing the thermoelectrons to collide against fluorescent material on an anode (segment) electrode and causing them to illuminate, by accelerating the thermoelectrons using a grid electrode. VFDs have excellent features in terms of visibility, multi-coloring, a low operating voltage, reliability (environmental resistance) etc. and are used in various applications and fields such as cars, home appliances and consumer products.

For a VFD, as one scheme for applying a voltage to its filament, pulse-driving scheme has been proposed. Pulse-driving scheme is a scheme in which a pulse voltage (hereinafter, referred to as "filament pulse voltage") generated by chopping a DC voltage relatively high compared to the ordinary rated voltage of the filament is applied to the filament, and has features that illuminating state having a small intensity gradient is obtained, etc.

Here, conventional VFD driving circuits intended for driving the VFD are equipped with an arrangement to adjust the VFD brightness so that the VFD can display at a proper brightness according to the surrounding environmental conditions (e.g., ambient illuminance). For example, this arrangement includes methods called grid dimming in which the duty ratio of the voltage applied to the grid electrode (hereinafter referred to as "grid voltage") is adjusted and anode dimming in which the duty ratio of the voltage applied to the segment (anode) electrode (hereinafter referred to as "segment voltage") is adjusted. Grid dimming leads to an inconstant amount of thermoelectrons between the filament and the grid as a result of variations in grid voltage pulse width, allegedly degrading the VFD display integrity. For this reason, anode dimming is drawing more attention lately than grid dimming.

Grid/anode dimming is carried out, for instance, based on a comparison table between dimmer adjustment data and dimmer values as shown in FIG. 7A. It is to be noted that dimmer adjustment data—data brought in correspondence with values that can be set as duty ratio of grid or segment voltage—is specified when grid/anode dimming is externally conducted on a VFD driving circuit. Dimmer adjustment data may also be binary data having the number of bits appropriate to the grid/anode dimming resolution as in the case of 10-bit binary data (DM0 to DM9) shown in FIG. 7A with DM0 being the LSB (Least Significant Bit). Meanwhile, dimmer value—a value that can be set as a duty ratio of grid or segment voltage—can be defined, by using a pulse width TW and a pulse period T indicated in the waveform diagram of FIG. 7B, as "pulse width TW/pulse period T."

Conventional VFD driving circuits have adopted one of the following to implement grid/anode dimming:

Embodiment A: Embodiment for performing grid dimming only (e.g., refer to "OKI Electronic Devices MSC12056 Datasheet (J2C0018-27-Y3)", [online] Prepared January 1998, OKI Electric Industry, [Searched Mar. 27, 2003], Embodiment B: Embodiment for performing anode dimming only (e.g., refer to "OKI Electronic Devices ML9213 Datasheet (FJDL9213-01)", [online] Prepared September 2000, OKI Electric Industry, [Searched Mar. 27, 2003], Embodiment C: Embodiment for performing both grid and anode dimming simultaneously (e.g., refer to "OKI Electronic Devices MSC1205-01 Datasheet (FJDL1215-03) ", [online] Prepared September 2000, OKI Electric Industry, [Searched Mar. 27, 2003], Here, a phenomenon called "ghost failure" will be described with reference to FIGS. 8A to 8C as an example of display operation of a VFD having a two-digit seven segment display as its display pattern.

As shown in FIG. 8A, the digit corresponding to a grid voltage G1 is scanned (a grid electrode G1 is driven) at period 1T, and concurrently a segment electrode Sm is driven, lighting up a segment Sm (1) shown in FIG. 8B.

Next, the digit corresponding to a grid electrode G2 is scanned (the grid electrode G2 is driven) at period 2T, and concurrently the segment electrode Sm is driven, lighting up a segment Sm (2) shown in FIG. 8B. Here, the grid voltage applied to the grid electrode G1 is supposed to essentially drop to a level that does not drive the grid electrode G1 before the segment Sm (2) lights up, thus causing the segment Sm (1) that was lit at period 1T to go out.

As shown in a dashed line area P in FIG. 8A, however, the waveform of the grid voltage applied to the grid electrode G1 becomes dull due, for example, to resistive and capacitive components in the wiring between the output terminal of the VFD driving circuit and the VFD grid electrode G1. This results in a period during which both the segments Sm (1) and Sm (2) are lit as shown in FIG. 8B.

It is to be noted that such a phenomenon is generally called "ghost failure" and constitutes one of the factors degrading the VFD display integrity. To eliminate such "ghost failure", VFD circuit must adjust the duty ratio of the grid voltage to an appropriate value (grid dimming), taking into consideration the effect of dulling of the waveform of the grid voltage applied to the grid electrode.

Meanwhile, "ghost failure" also takes place as shown in FIG. 8C in a dotted line area Q in FIG. 8A. In this case, the segment voltage applied to the segment electrode Sm is supposed to essentially drop to a level that does not drive the segment electrode Sm at period 4T before a segment Sn (2) shown in FIG. 8C lights up, thus causing the segment Sm (2) shown in FIG. 8C that was lit at period 3T to go out.

Because of the same cause as the dulling of the grid voltage waveform described earlier, however, the segment voltage applied to the segment electrode Sm dulls, resulting in a period during which both the segments Sm (2) and Sn (2) are lit as shown in FIG. 8C. In this case, the VFD circuit must adjust the duty ratio of the segment voltage to an appropriate value (anode dimming), taking S into consideration the effect of dulling of the waveform of the segment voltage applied to the segment electrode.

The above is the description of the phenomenon called "ghost failure." Incidentally, conventional VFD driving circuits are only capable of either grid or anode dimming in the case of the embodiment A or B, thus making it impossible to eliminate the "ghost failure."

On the other hand, the embodiment C of conventional VFD driving circuits performs both grid and anode dimming concurrently to eliminate the "ghost failure." However, grid dimming is performed simultaneously with anode dimming at a time when anode dimming alone is enough (e.g., the dotted line area Q in FIG. 8A). This leads to an unstable amount of thermoelectrons between the filament and grid electrodes, degrading the VFD display integrity.

SUMMARY OF THE INVENTION

In order to solve the above problems, a major aspect of the present invention provides a driving circuit for a vacuum fluorescent display having a filament, a grid electrode and a segment electrode, comprising a grid driving unit for pulse-driving the grid electrode, a segment driving unit for pulse-driving the segment electrode, a first controlling unit for rendering adjustable the duty ratio of the output of the grid driving unit, a second controlling unit for rendering adjustable the duty ratio of the output of the segment driving unit, and a selecting unit for selecting the first controlling unit and/or the second controlling unit.

It is possible according to the present invention to provide a vacuum fluorescent display driving circuit that improves the display integrity of the vacuum fluorescent display.

Other features of the present invention will become clear from the descriptions of this specification and accompanying drawings.

BRIEF DESCRIPTION OF THE DRAWINGS

The above and other features, aspects and advantages of the present invention will be understood more clearly with reference to the following description, appended claims and accompanying drawings.

FIG. 4 is a table describing settings of dimmer type select flags according to one embodiment of the present invention;

DETAILED DESCRIPTION OF THE INVENTION

Embodiments of the present invention will be described below with reference to accompanying drawings.

<System Configuration>

Figure 1:
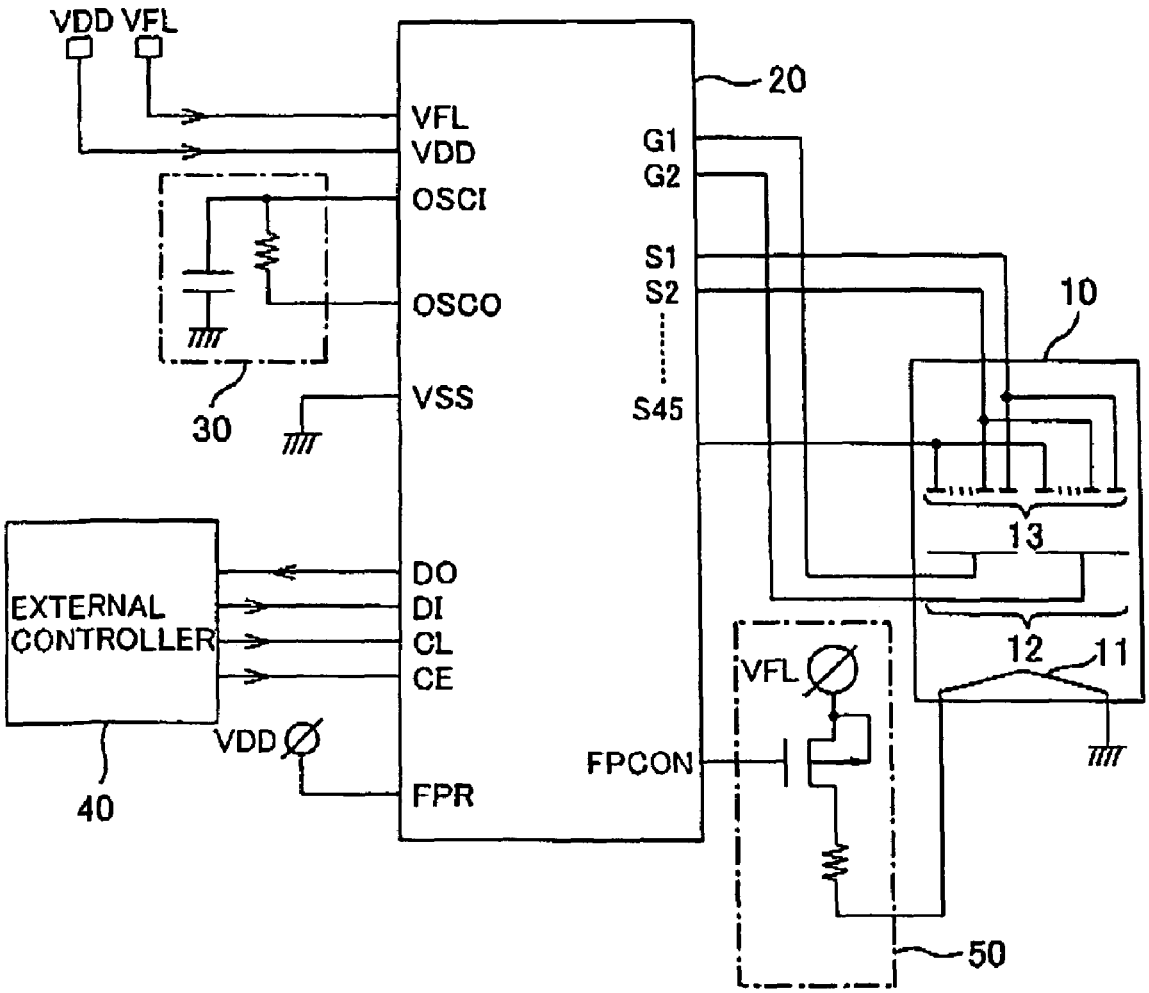
FIG. 1 is a schematic configuration diagram of a system including a vacuum fluorescent display driving circuit according to one embodiment of the present invention.

FIG. 1 is a schematic configuration diagram of a system including a VFD driving circuit 20 that is an embodiment of the present invention. The VFD driving circuit 20 shown in the figure adopts the pulse drive system as a method of applying voltage to a filament 11. The pulse drive system applies a pulse voltage (hereinafter referred to as "filament pulse voltage")—chopped DC voltage quite higher than the normal rated voltage of the filament 11—to the filament 11. It is to be noted that the method of applying voltage to the filament 11 is not limited to the pulse drive system in the VFD driving circuit 20 according to the present invention, and the AC or DC drive system may be used.

The VFD driving circuit 20 shown in the figure adopts the dynamic drive system for driving a grid electrode 12 and a segment electrode 13, with two digits displayed by the grid electrode 12 (such an embodiment of the grid electrode 12 is referred to as "½ duty") and "90" segment outputs. The VFD driving circuit 20 according to the invention is not limited to those with the above-described number of grids (two-column) and the number of segments (90 segments), and the grid electrode 12 and the segment electrode 13 may be driven in a driving scheme in which either of the dynamic driving scheme or static driving scheme is combined. For example, in the case where the static driving scheme is employed, all of the column display is executed by the segment electrodes 13 of the number same as the number of the segments and one grid electrode 12. In this case, a constant voltage (grid voltage) is applied to the one grid electrode 12.

The overview of the dynamic driving scheme and the static driving scheme described above are described in, for example, "Display Technologies Series: Vacuum Fluorescent Displays 8.2 The Basic Driving Circuits (pp. 154-158)", Sangyo Tosho.

As to the peripheral circuits of the VFD driving circuit 20, the VFD 10, the external oscillator 30, the external controller 40 and a switching element 50 will be described in this order.

The VFD 10 comprises the filament 11, the grid electrode 12 and the segment (anode) electrode 13. The filament 11 is heated by applying a filament pulse voltage thereto based on the pulse driving scheme through the switching element 50, and emits thermoelectrons. The grid electrode 12 acts as an electrode for selecting columns and accelerates or blocks the thermoelectrons emitted by the filament 11. The segment electrode 13 acts as an electrode for selecting a segment. However, fluorescent material is applied on the surface of the segment electrode 13 in a shape of the pattern to be displayed, and a desired pattern is displayed by causing the fluorescent material to illuminate by causing the thermoelectrons accelerated by the grid electrode 12 to collide against the fluorescent material.

Furthermore, in the VFD 10, a lead is drawn out independently for each column respectively from the grid electrode 12 while a lead for which segments corresponding to each column are internally connected with each other is drawn out from the segment electrode 13. These leads drawn from the grid electrode 12 and the segment electrode 13 are connected respectively with corresponding output terminals of the VFD driving circuit 20 (grid output terminals are G1-G2 and segment output terminals are S1-S45).

The external oscillator 30 is an RC oscillator comprising a resistor R, a capacitance element C etc. and constitutes an RC oscillation circuit by being connected with oscillator terminals (OSCI terminal, OSCO terminal) of the VFD driving circuit 20. The external oscillator 30 may be a quartz-crystal oscillator or ceramic vibrator each having a specific oscillation frequency and a crystal as a self-driving oscillation unit or a ceramic oscillation circuit. Furthermore, the external oscillator 30 may be an externally-driven oscillating unit providing a clock signal for externally-driven oscillation to the VFD driving circuit 20.

The external controller 40 is an apparatus such as a microcomputer not containing any VFD driving element, and is connected with the VFD driving circuit 20 through data bus for transferring serial data, and transmits signals necessary for driving the VFD 10 to the VFD driving circuit 20 in a predetermined data transfer format. The data transfer between the external controller 40 and the VFD driving circuit 20 is not limited to the serial data transfer described above and may be parallel data transfer.

The switching element 50 is a P-channel MOS-type FET and its gate terminal is connected with an FPCON terminal of the VFD driving circuit 20, outputting the pulse driving signal described later. The switching element 50 is not limited to the P-channel MOS-type FET and, for example, an N-channel MOS-type FET may be used and, in addition, a composition in which an N-channel MOS-type FET and a P-channel MOS-type FET are combined may be used. Furthermore, the switching element 50 generates the filament pulse voltage to be applied to the filament 11 of the VFD 10 from a filament power voltage VFL by executing ON/OFF operation in response to the pulse driving signal provided from an FPCON terminal of the VFD driving circuit 20.

An FPR terminal of the VFD driving circuit 20 shown in FIG. 1 is an input terminal for setting the polarity of the pulse driving signal outputted from an FPCON terminal in response to the input/output property of the switching element 50 and, for example, as shown in FIG. 1, in the case where a P-channel MOS-type FET is employed as the switching element 50, the FPR terminal is connected with a power voltage VDD ("H"-fixed). In addition, in the case where an N-channel MOS-type FET is employed as the switching element 50, the FPR, terminal is connected with ground ("L"-fixed).

Figure 2:
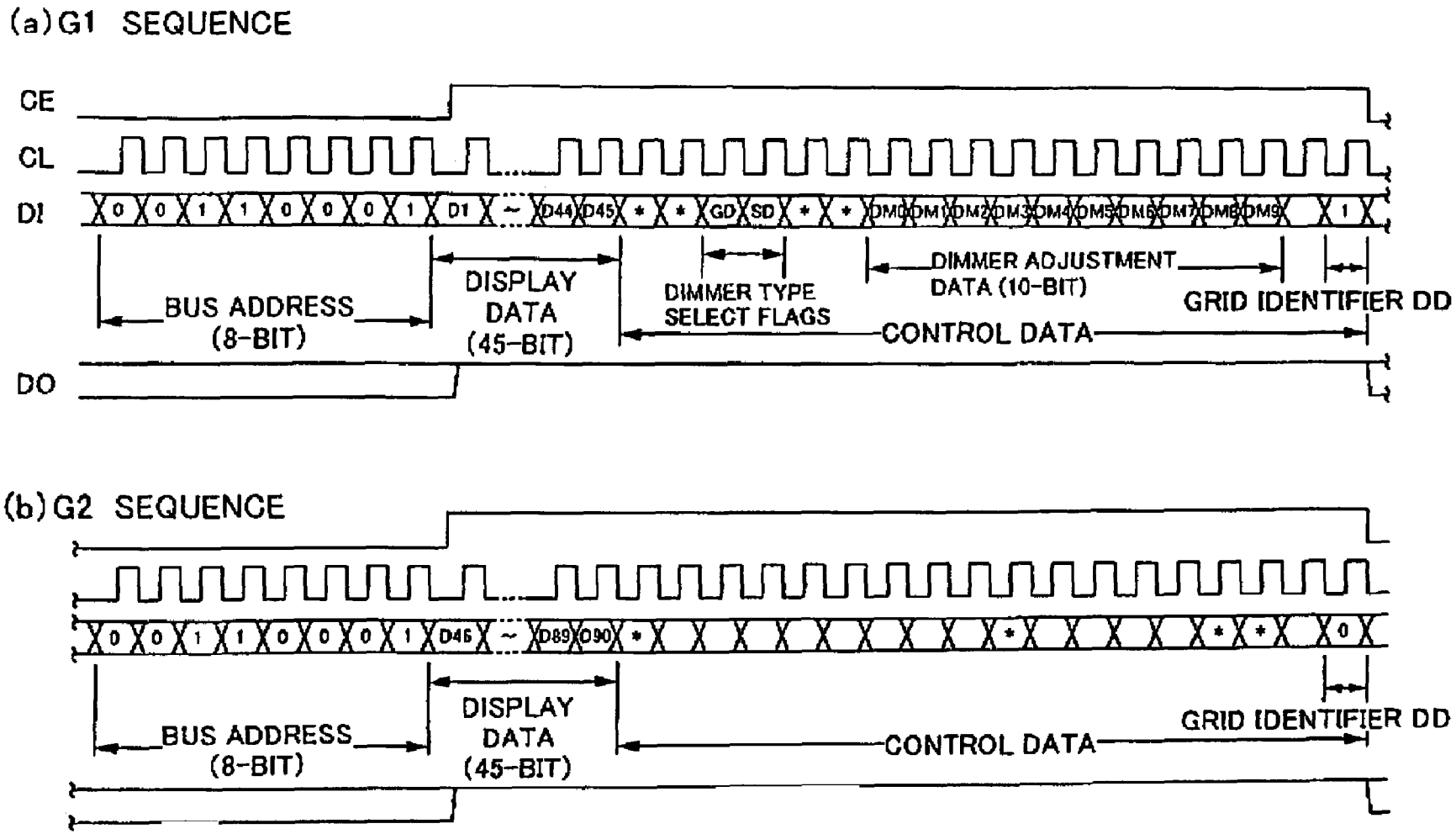
FIG. 2 shows timing charts for data transfer formats between an external controller and the vacuum fluorescent display driving circuit according to one embodiment of the present invention.

FIG. 2 shows a timing chart for a data transfer format between the external controller and the VFD driving circuit 20. As shown in the figure, the data transfer format has a sequence relating to a grid electrode G1 (hereinafter, referred to as "G1 sequence") and a sequence relating to a grid electrode G2 (hereinafter, referred to as "G2 sequence"). The data transfer format is not limited to the format described above and both of the G1 sequence and the G2 sequence may be executed at one time.

The G1 sequence will be described schematically. The G2 sequence will not be described since it is a procedure similar to the G1 sequence.

First, in the G1 sequence, the external controller 40 transmits to the VFD driving circuit 20 a bus address (8 bits) given to the VFD driving circuit 20 together with a synchronizing clock signal CL. The VFD driving circuit 20 identifies whether the received address is the bus address given to the circuit 20 itself or not. Then, when the circuit 20 identifies the bus address as the bus address given to the circuit 20 itself, the circuit 20 receives a control order (control data etc. described later) transmitted as attached to the received bus address from the external controller 40 as a control order to the circuit 20 itself. As described above, a bus address is a specific address given to each respective IC and is used for the external controller 40 to control a plurality of ICs on the same bus line in an embodiment where the external controller 40 and the plurality of ICs are connected on the same bus line.

Next, the external controller 46 makes the VFD driving circuit 20 be in an enable (selection) state by asserting (putting at the H level) a chip enable signal CE and, then, transmits 45-bit display data (D1-D45) for the grid electrode G1, 16-bit control data used for each control of the VFD driving circuit 20 etc.

It is to be noted that 16-bit control data contains, for example, dimmer type select flags (GD, SD), 10-bit dimmer adjustment data (DM0 to DM9) for at least either of grid or anode dimming and a grid identifier DD (e.g., "1" for the grid electrode G1 and "0" for the grid electrode G2).

Then, the external controller 40 negates a chip enable signal CE (pulls to L level), puts the VFD driving circuit 20 in a disabled (unselected) state and stops transmission of the synchronizing clock signal CL, thus completing the G1 sequence.

<VFD Driving Circuit>

Figure 3:
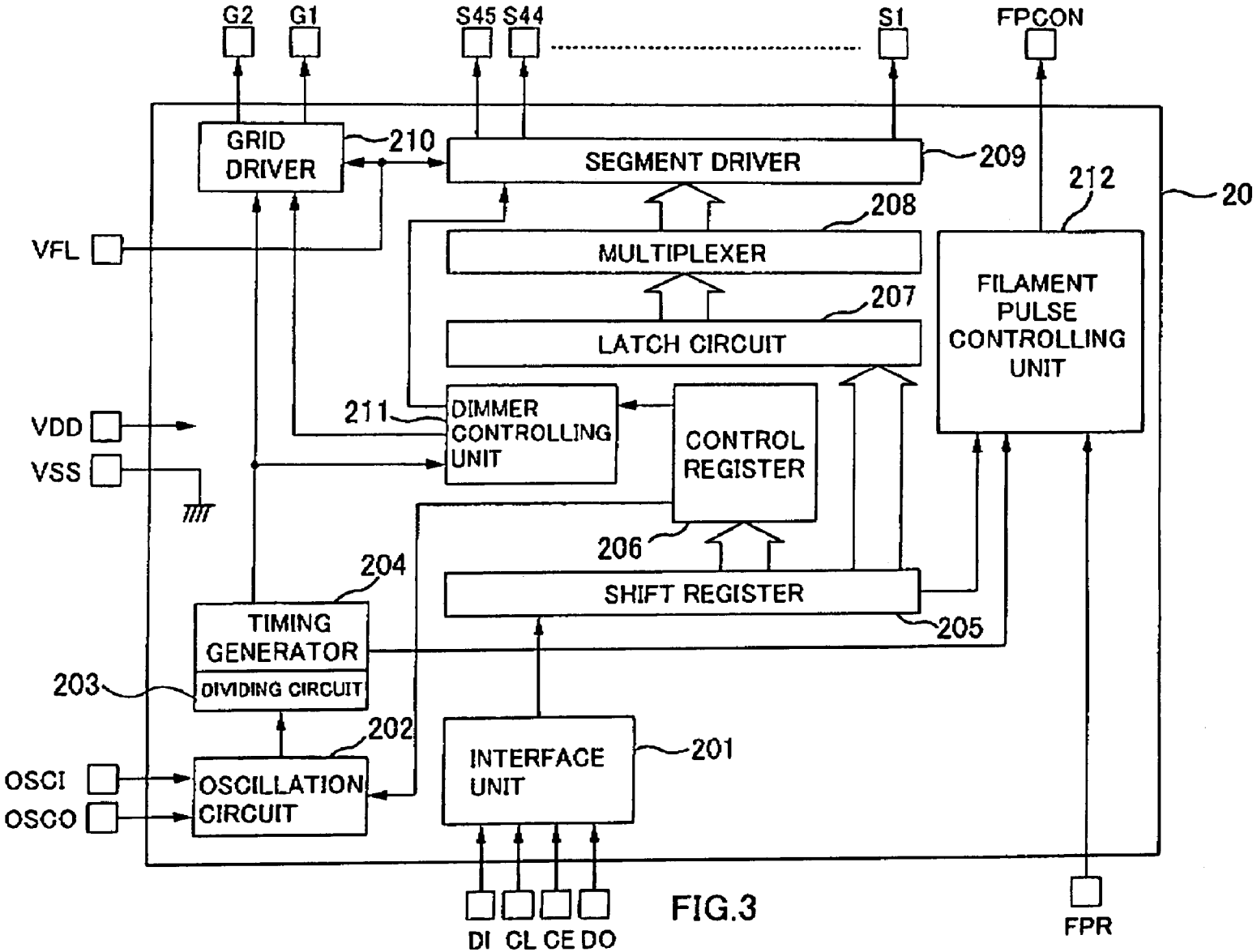
FIG. 3 is a block diagram of the vacuum fluorescent display driving circuit according to one embodiment of the present invention.

FIG. 3 shows a block diagram of the VFD driving circuit 20 of the pulse driving scheme according to the invention.

The VFD driving circuit 20 comprises an interface unit 201, an oscillation circuit 202, a dividing circuit 203, a timing generator 204, a shift register 205, a control register 206, a latch circuit 207, a multiplexer 208, a segment driver 209, a grid driver 210, a dimmer controlling unit 211 and a filament pulse controlling unit 212.

The interface unit 201 is an interface unit for transmitting/receiving of data as shown in FIG. 2 with the external controller 40.

The oscillation circuit 202 generates the reference clock signal for the VFD driving circuit 20 by connecting the external oscillator 30 with the terminals for oscillator (OSCI, OSCO). This reference clock signal is divided into a predetermined dividing number by the dividing circuit 203 and supplied to the timing generator 204.

The timing generator 204 outputs a signal (hereinafter, referred to as "internal clock signal A") for determining the timing etc. of a signal (hereinafter, referred to as "grid driving signal") for driving the grid electrodes G1-G2 based on the signal supplied from the dividing circuit 203, and a signal (hereinafter, referred to as "internal clock signal D1" for determining the timing of a pulse driving signal described later in the filament pulse controlling unit 212, etc.

The shift register 205 converts 45-bit display data (D1 to D45 or D46 to D90) and 16-bit control data (dimmer type select flags (GD, SD) described later, dimmer adjustment data (DM0 to DM9)), received by the interface unit 201 for each of the G1 or G2 sequence, to parallel data and supplies the data to the control register 206, the latch circuit 207, the filament pulse controlling unit 212, etc.

The control register 206 stores 32-bit (16 bits×2) control data supplied from the shift register 205. It is to be noted that the dimmer type select flags (GD, SD) and the dimmer adjustment data described later are supplied to the dimmer controlling unit 211.

The latch circuit 207 retains 45-bit display data (D1 to D45) related to the grid electrode G1 and 45-bit display data (D46 to D90) related to the grid electrode G2 supplied from the shift register 205. That is, the latch circuit 207 retains 90-bit display data (D1 to D90) in every cycle period related to driving of the grid electrodes G1 and G2.

The multiplexer 208 selects, from the 90-bit display data (D1 to D90) retained by the latch circuit 207, the 45-bit display data related to the grid electrode G1 or G2 to be driven at each drive timing of the grid electrode G1 and G2 and supplies the data to the segment driver 209.

The segment driver 209 forms a signal for driving segment electrodes S1-S45 based on the 45-bit display data selected and supplied by the multiplexer 208, and outputs it to the segment electrodes S1-S45. The signal for driving the segment electrodes S1-S45 may be voltages to be applied to the segment electrodes S1-S45 (hereinafter, referred to as "segment voltage") or a control signal to be supplied to a driving element intervened between the segment driver 209 and the segment electrodes S1-S45 (hereinafter, the segment voltage and the control signal are collectively referred to as "segment driving signal").

The grid driver 210 forms a grid driving signal based on the internal clock signal A supplied from the timing generator 204 and outputs it to the grid electrodes G1-G2. The signal for driving the grid electrodes G1-G2 may be a voltage (hereinafter, referred to as "grid voltage") to be applied to the grid electrodes G1-G2 or a control signal to be supplied to a driving element intervened between the grid driver 210 and the grid electrodes G1-G2 (hereinafter, the grid voltage and the control signal are collectively referred to as "grid driving signal").

The dimmer controlling unit 211 has two controlling units; one for rendering adjustable the duty ratio of the grid drive signal (hereinafter referred to as "first controlling unit") and another for rendering adjustable the duty ratio of the segment drive signal (hereinafter referred to as "second controlling unit"), with both duty ratios rendered adjustable based on the dimmer adjustment data (DM0 to DM9) supplied from the control register 206. The dimmer controlling unit 211 can select at least one of the first and second controlling units based on the dimmer type select flags (GD, SD) described later that are supplied from the control register 207.

The filament pulse controlling unit 212 forms the pulse driving signal for pulse-driving the filament 11 based on the internal clock signal B supplied from the timing generator 204 and outputs it to the switching element 50 via the FPCON terminal. The filament pulse controlling unit 212 sets the polarity of the pulse driving signal based on a signal supplied from the FPR terminal.

The dimmer controlling unit 211, the unit that performs an operation characteristic of the present invention, will be described below.

<Dimmer Controlling Unit>

===Dimmer Type Select Flags===

A description will be given first of an embodiment of the dimmer type select flags for selecting at least either of the first or second controlling unit with reference to FIG. 4.

The dimmer type select flags have the GD flag for selecting the first controlling unit and the SD flag for selecting the second controlling unit as shown in the figure.

When the VFD driving circuit 20 receives, for example, "1" as the status of the GD flag (or SD flag) from the external controller 40, the VFD driving circuit 20 adjusts the duty ratio of the grid drive signal (or segment drive signal) based on the dimmer adjustment data (DM0 to DM9) received together with the GD flag (or SD flag). That is, the VFD driving circuit 20 selects the first controlling unit (or second controlling unit) when the status of the GD flag (or SD flag) is "1."

Figure 8A:
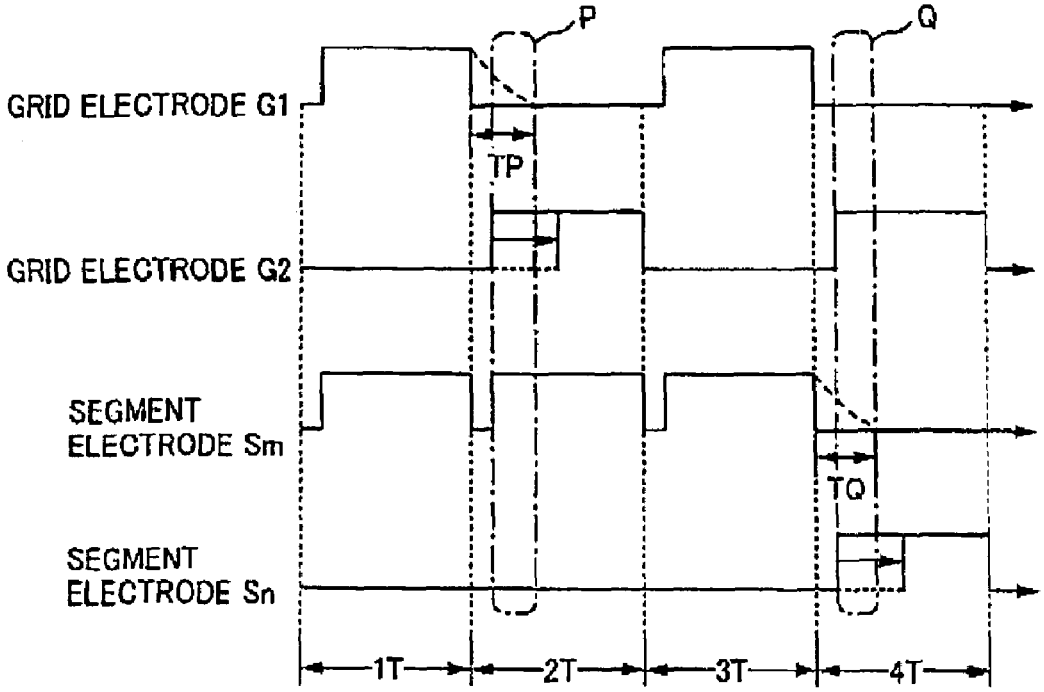
PRIOR ART FIG.8A
FIGS. 8A to 8C are explanatory views describing "ghost failure."
Figure 8B:
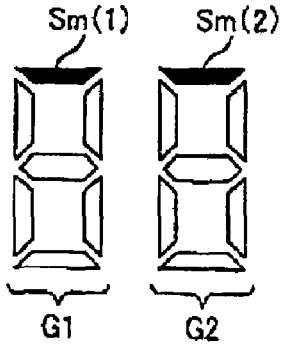
PRIOR ART FIG.8B
Figure 8C:
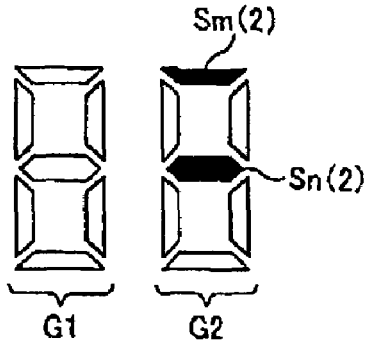
PRIOR ART FIG.8C

On the other hand, when the VFD driving circuit 20 receives, for example, "0" as the status of the GD flag (or SD flag) from the external controller 40, the VFD driving circuit 20 sets the duty ratio of the grid drive signal (or segment drive signal) to a given duty ratio. This given duty ratio may be, for example, set to a value as described below. First, the pulse width time of the grid voltage (or segment voltage) is determined to be that excluding the time during which the grid voltage (or segment voltage) dulls at the previous cycle. Such a pulse width of the grid voltage (segment voltage), divided by the pulse period of the grid voltage (or segment voltage), may be set as the given duty ratio. It is to be noted that the time during which the grid voltage (segment voltage) dulls refers, for example, to a time TP (or time TQ) shown in FIG. 8A.

===Circuit Configuration===

A description will be given of the circuit configuration of the dimmer controlling unit 211 according to the present invention as an embodiment with reference to FIG. 5. It is to be noted that the description will be given below concurrently using the timing charts of major signals of the dimmer controlling unit 211 shown in FIGS. 6 as necessary.

The dimmer controlling unit 211 has first and second controlling units 810 and 811, first multiplexer units 812 (812*a*, 812*b*) provided as many as the number of grid output terminals (two in the figure), second multiplexer units 813 (813*a*, 813*b*) provided as many as the number of segment output terminals (45 in the figure), a latch unit 814 and a third multiplexer unit 815.

The first and second controlling units 810 and 811 identify, based on the dimmer adjustment data (DM0 to DM9) received from the external controller 40, a dimmer value (TW/T) that corresponds to the dimmer adjustment data (DM0 to DM9). Then, the first and second controlling units 810 and 811 generate, from a reference clock signal (FIG. 6(*a*)) and an internal clock signal A (FIG. 6(*b*)) supplied from a timing generator 204, a dimmer control signal (FIG. 6(*d*)) having a pulse width that corresponds to the dimmer value and output the dimmer control signal. It is to be noted that, in the dimmer control signal shown in FIG. 6(*d*), the pulse width between time t2 and t3 and between time t5 and t6 represents the pulse width appropriate to the dimmer value (TW/T) that corresponds to the dimmer adjustment data (DM0 to DM9).

Figure 5:
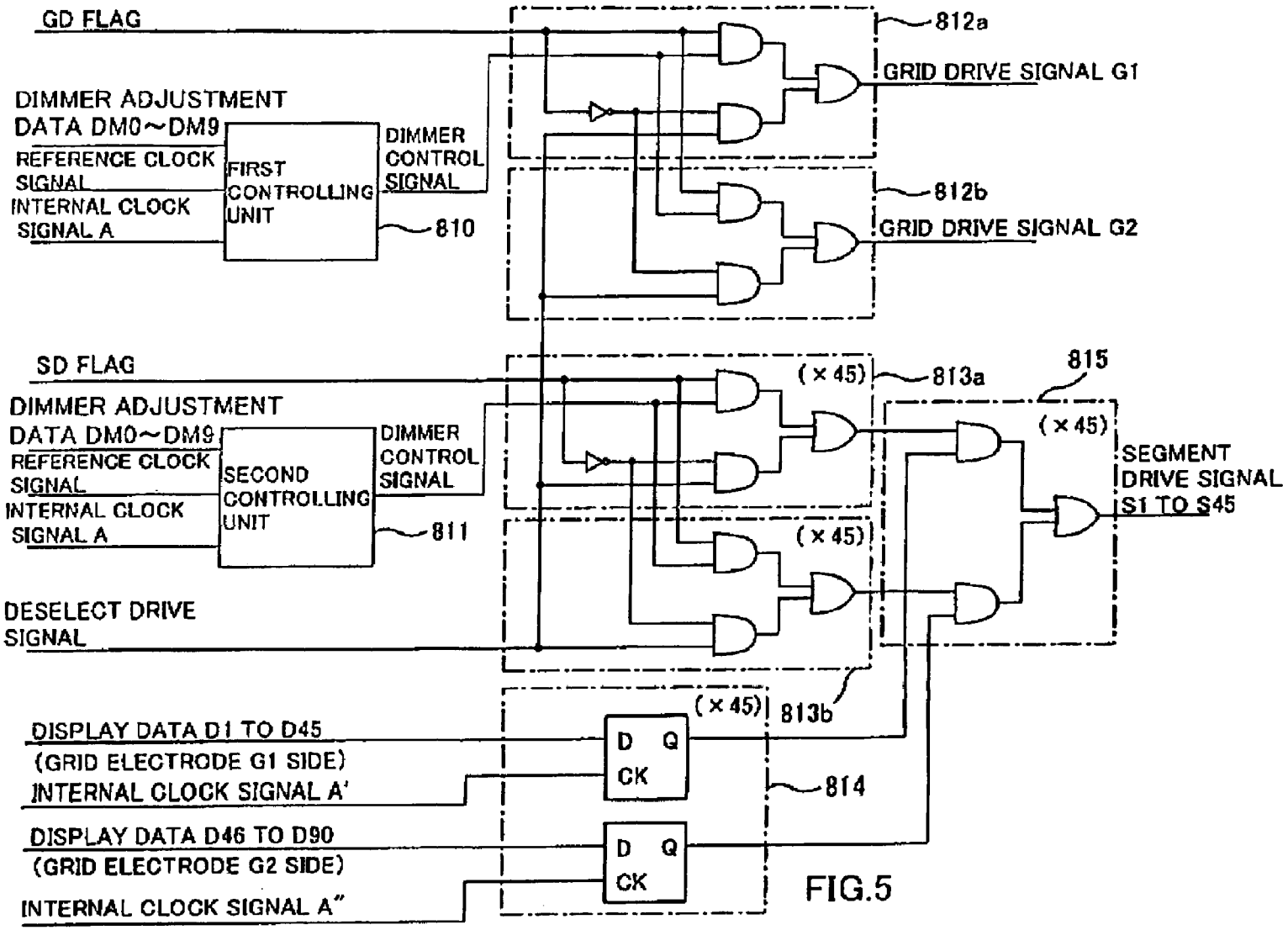
FIG. 5 is a circuit configuration diagram of a dimmer controlling unit according to one embodiment of the present invention.
Figure 6:
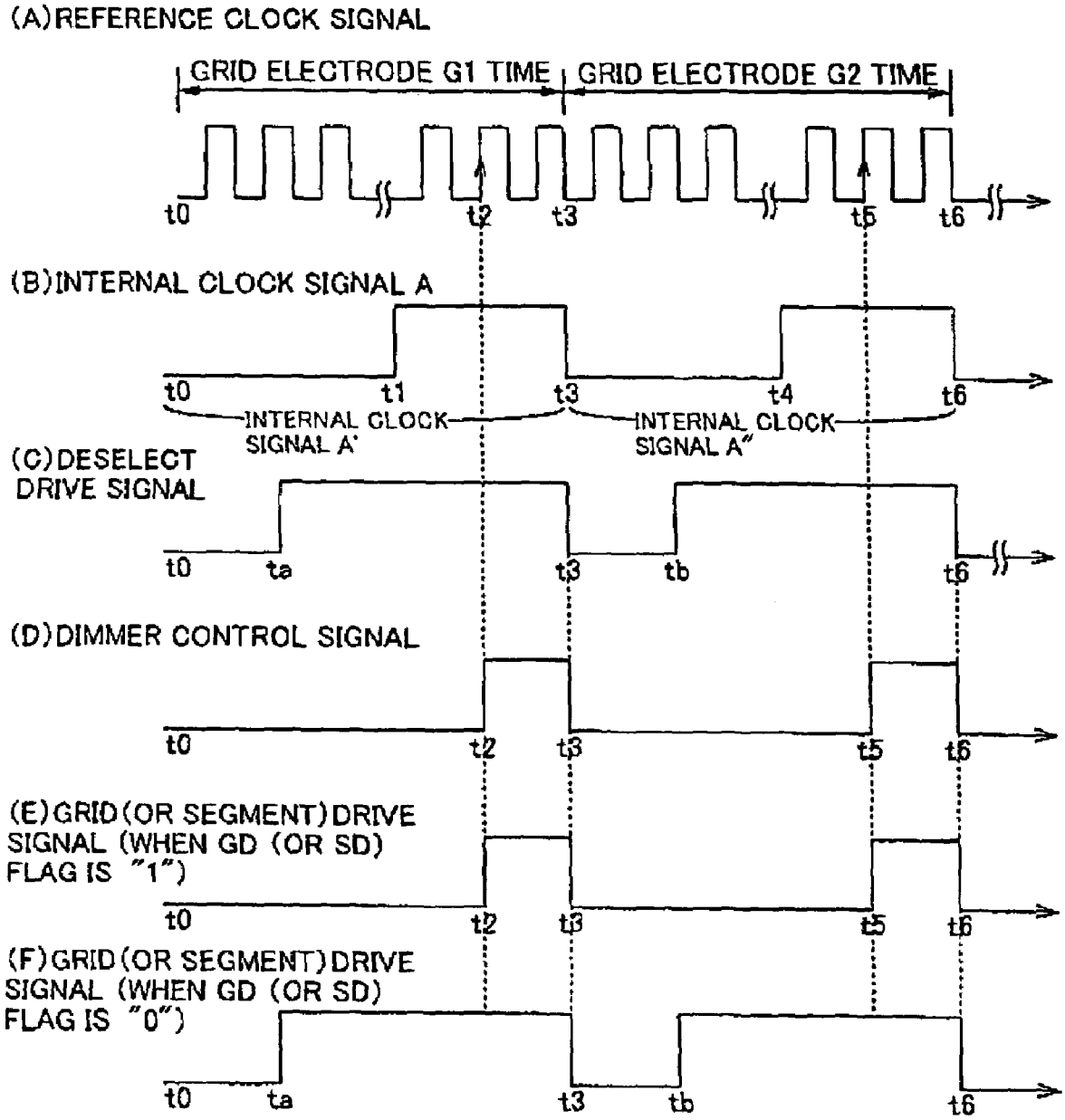
FIG. 6 shows timing charts describing, as an embodiment, the operations of the dimmer controlling unit according to one embodiment of the present invention.
Figures 7A, 7B:
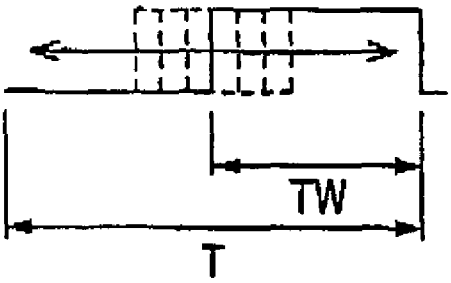
PRIOR ART FIG.7A
PRIOR ART FIG.7B
FIGS. 7A and 7B are explanatory views describing an example of a comparison table between dimmer adjustment data and dimmer values.

Incidentally, the first and second controlling units 810 and 811 shown in FIG. 5 operate so as to generate and output the dimmer control signal (FIG. 6(*d*)) upon receipt of the dimmer adjustment data (DM0 to DM9) from the external controller 40, irrespectively of the statuses of the dimmer type select flags (GD, SD). In addition to such an embodiment, the first and second controlling units 810 and 811 may alternatively generate and output the dimmer control signal (FIG. 6(*d*)) if they receive the dimmer adjustment data (DM0 to DM9) from the external controller 40 and also if the statuses of the dimmer type select flags (GD, SD) are "1."

The first multiplexer units 812 output, as the grid drive signal, the dimmer control signal (FIG. 6(*d*)) that serves as an output of the first controlling unit 810 when the status of the GD flag is "1." On the other hand, the first multiplexer units 812 output a deselect drive signal (FIG. 6(*c*)) having a given duty ratio when the status of the GD flag is "0."

It is to be noted that the deselect drive signal (FIG. 6(*c*)) is, for example, assumed to be a signal generated by the timing generator 204 from the reference clock signal via a given counter unit (not shown). Meanwhile, the given duty ratio of the deselect drive signal is, as described earlier, assumed to be a value calculated in consideration of dulling of the grid voltage (or segment voltage).

The second multiplexer units 813 output the dimmer control signal (FIG. 6(*d*)), that serves as an output of the second controlling unit 811, to the third multiplexer unit 815 when the status of the SD flag is "1." On the other hand, the second multiplexer units 813 output the deselect drive signal (FIG. 6(*c*)) having a given duty ratio as with the first multiplexer units 812 when the status of the SD flag is "0."

The latch unit 814 latches, each time the grid electrode G1 or G2 is driven and at given timings, display data (D1 to D45 and D46 to D90) bound for the segment electrode 13 corresponding to the grid electrode 12 to be driven. It is to be noted that, in the figure, the latch timing of the display data (D1 to D45) is the leading edge of the pulse signal (internal clock signal A') corresponding to the grid electrode G1 time of the internal clock signal A (FIG. 6(*b*)), whereas the latch timing of the display data (D46 to D90) is the leading edge of the pulse signal ("internal clock signal A") corresponding to the grid electrode G2 time of the internal clock signal A (FIG. 6(*b*)).

The third multiplexer unit 815 successively outputs, each time the grid electrode G1 or G2 is driven, the segment drive signal appropriate to the grid electrode 12 to be driven, based on the outputs of the second multiplexer units 813 and the latch unit 814.

The dimmer controlling unit 211 outputs the grid drive signal (or segment drive signal) shown in FIG. 6(*e*) when the status of the GD flag (or SD flag) is "1" and the grid drive signal (or segment drive signal) shown in FIG. 6(*f*) when the status of the GD flag (or SD flag) is "0."

As described above, the VFD driving circuit 20 according to the present invention can select the duty ratio adjustment of at least either of the grid drive signal (grid dimming) or segment drive signal (anode dimming) at a proper timing. This eliminates, for example, "ghost failure" attributed to voltage dulling at the grid electrode 12 or the segment electrode 13. That is, it is possible to improve the display integrity of the vacuum fluorescent display by using the VFD driving circuit 20.

===Other Embodiments===

As the aforementioned embodiment, the VFD driving circuit 20 according to the present invention may be provided with a unit for detecting voltage dulling at the grid electrode 12 or the segment electrode 13 and arranged to select at least one of the first and second controlling units 810 and 811 in the event of detection of voltage dulling at the grid electrode 12 or the segment electrode 13.

It is to be noted that, in the present embodiment, the dimmer adjustment data (DM0 to DM9) input to the first controlling unit 810 (or second controlling unit 811) is a value set in consideration of grid voltage (or segment voltage) dulling as with the duty ratio of the deselect drive signal and that the data is stored in a given storage unit of the VFD driving circuit 20. Then, the dimmer adjustment data (DM0 to DM9) corresponding to the given duty ratio may be read out from the storage unit based on the detection results by the detection unit for use as input to the first controlling unit 810 or the second controlling unit 811.

Such an arrangement also allows the VFD driving circuit 20 to eliminate "ghost failure" arising out of voltage dulling at the grid electrode 12 or the segment electrode 13, thus improving the display integrity of the vacuum fluorescent display.

As the aforementioned embodiment, the VFD driving circuit 20 may be implemented in the form of a semiconductor integrated circuit and provided with an interface for allowing external connection of a switching device 50 that generates a voltage for pulse-driving the filament 11.

Further as the aforementioned embodiment, various application circuits (e.g., vacuum fluorescent display module) using the VFD driving circuit 20 according to the present invention may be provided with the switching device 50. Preferably, the VFD driving circuit 20 may be implemented in the form of a semiconductor integrated circuit with the switching device 50 being externally connectable or may be implemented in the form of a semiconductor integrated circuit incorporating the integrated switching device 50.

What is claimed is:

1. A driving circuit for a vacuum fluorescent display having a filament, a grid electrode and a segment electrode, comprising:

a first controlling unit configured to receive a first dimmer adjustment data for adjusting duty ratio of a grid drive signal that is a drive signal to the grid electrode, and to output a first dimmer control signal having duty ratio corresponding to the first dimmer adjustment data;

a second controlling unit configured to receive a second dimmer adjustment data for adjusting duty ratio of a segment drive signal that is a drive signal to the segment electrode, and to output a second dimmer control signal having duty ratio corresponding to the second dimmer adjustment data;

a first multiplexer unit configured to output either the first dimmer control signal output from the first controlling unit or a driving signal having a predetermined duty ratio as the grid drive signal, based on a first dimmer type select flag indicating whether duty ratio of the grid drive signal should be adjusted or not; and a second multiplexer unit configured to output either the second dimmer control signal output from the second controlling unit or a driving signal having a predetermined duty ratio as the segment drive signal, based on a second dimmer type select flag indicating whether duty ratio of the segment drive signal should be adjusted or not.

2. The driving circuit for a vacuum fluorescent display according to claim 1, wherein a pulse width of the driving signal having the predetermined duty ratio output from the first multiplexer unit excludes a width associated with a time during which a voltage applied to the grid electrode dulls, and wherein a pulse width of the driving signal having the predetermined duty ratio output from the second multiplexer unit excludes a width associated with a time during which a voltage applied to the segment electrode dulls.

3. The driving circuit for a vacuum fluorescent display according to claim 1, wherein the driving circuit is a semiconductor integrated circuit having a filament driving unit for pulse-driving the filament, with a switching device externally connectable for generating a voltage for pulse-driving the filament.

4. The driving circuit for a vacuum fluorescent display according to claim 1, wherein the driving circuit comprises a switching device for generating a voltage for pulse-driving the filament.

5. The driving circuit for a vacuum fluorescent display according to claim 4, wherein the driving circuit is a semiconductor integrated circuit, with the switching device being externally connectable.

6. The driving circuit for a vacuum fluorescent display according to claim 4, wherein the driving circuit is a semiconductor integrated circuit having the switching devices integrated therein.

* * * * *